US008844889B2

(12) United States Patent
Smith

(10) Patent No.: US 8,844,889 B2
(45) Date of Patent: Sep. 30, 2014

(54) PROTECTION STAND

(75) Inventor: Matthew Smith, Wooster, OH (US)

(73) Assignee: Waxman Consumer Products Group Inc., Bedford Heights, OH (US)

( * ) Notice: Subject to any disclaimer, the term of this patent is extended or adjusted under 35 U.S.C. 154(b) by 0 days.

(21) Appl. No.: 13/491,738

(22) Filed: Jun. 8, 2012

(65) Prior Publication Data

US 2013/0146734 A1 Jun. 13, 2013

Related U.S. Application Data

(60) Provisional application No. 61/495,087, filed on Jun. 9, 2011.

(51) Int. Cl.
*B32B 3/00* (2006.01)
*A47B 91/00* (2006.01)
*A47B 91/04* (2006.01)

(52) U.S. Cl.
CPC ..... *A47B 91/005* (2013.01); *A47B 91/04* (2013.01)
USPC ..... 248/346.01; 428/98

(58) Field of Classification Search
USPC ..... 248/346.01, 632, 633, 634, 678, 687; 428/98, 99
See application file for complete search history.

(56) References Cited

U.S. PATENT DOCUMENTS

| | | | | | |
|---|---|---|---|---|---|
| 4,328,275 | A * | 5/1982 | Vargo | 428/156 |
| 4,421,809 | A * | 12/1983 | Bish et al. | 428/90 |
| 4,482,592 | A * | 11/1984 | Kramer | 428/67 |
| 4,609,580 | A * | 9/1986 | Rockett et al. | 428/198 |
| 4,822,669 | A * | 4/1989 | Roga | 442/373 |
| 5,073,428 | A * | 12/1991 | Lancelot et al. | 428/67 |
| 5,500,267 | A * | 3/1996 | Canning | 428/68 |
| RE36,677 | E * | 5/2000 | Reuben | 156/219 |
| 6,554,782 | B2 * | 4/2003 | Robbins et al. | 601/28 |
| 6,589,631 | B1 * | 7/2003 | Suzuki et al. | 428/172 |
| 8,075,971 | B1 * | 12/2011 | Horian | 428/61 |
| 2007/0042159 | A1 * | 2/2007 | Sugihara et al. | 428/156 |

* cited by examiner

*Primary Examiner* — Steven Marsh
(74) *Attorney, Agent, or Firm* — Tarolli, Sundheim, Covell & Tummino LLP

(57) ABSTRACT

A protection stand comprises a planar surface having first and second sides. The first side of the planar surface comprises a plurality of conical stands that converge away from the planar surface. The second side comprises first and second layers, wherein the first layer is positioned between the planar surface and the second layer and comprises an adaptable cushion for conforming to the surface area of the object resting on the protection stand. The second layer comprises an assembly side and an attachment side, both of such sides comprising an adhesive bond for securing the assembly side to the first layer and the attachment side to the cross-sectional surface of the object resting on the protection stand.

17 Claims, 3 Drawing Sheets

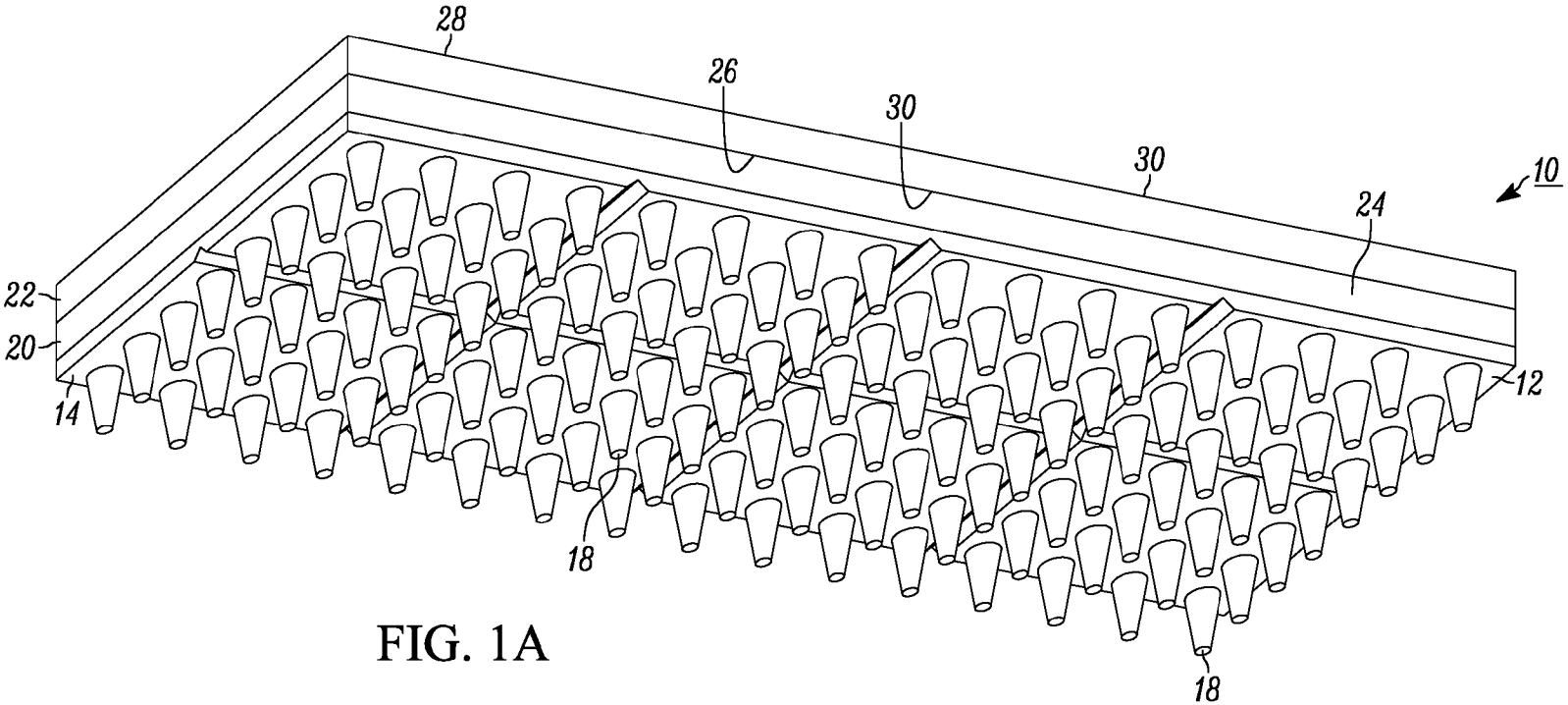
FIG. 1A
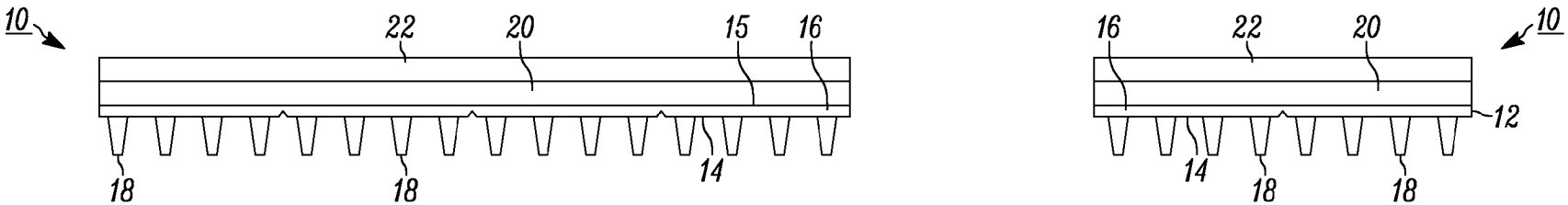
FIG. 1B
FIG. 1C

PROTECTION STAND

CROSS REFERENCES TO RELATED APPLICATIONS

The following application claims priority to U.S. Provisional Patent Application Ser. No. 61/495,087 filed Jun. 9, 2011 entitled PROTECTION STAND. The above-identified application is incorporated herein by reference in its entirety for all purposes.

TECHNICAL FIELD

The present disclosure relates to a protection stand, and more particularly, a protection stand that is secured to an object to protect the surface upon which the object rests.

BACKGROUND

Positioning of objects such as furniture that is intended to include, but not limited to, tables, chairs, beds, appliances, file cabinets, televisions, bookshelves, and couches may cause damage to the floor upon which they rest over significant periods of time. This is particularly true when the floor is covered with carpeting.

Typically, manufactures wish to provide potential buyers of furniture with as many options as possible. As a result, the construction of the furniture, and more specifically, the geometrical make of the area contacting the floor or carpet tends to vary significantly. This can be seen with the number of options and styles of furniture legs available having differing cross-sectional areas. The furniture contact area through the weight of the furniture, undesirably over time compresses the carpet, carpet backing, carpet pile, carpet pad, or any combination thereof.

SUMMARY

One example embodiment of the present disclosure includes a protection stand comprising a planar surface having first and second sides. The first side of the planar surface comprises a plurality of conical stands that converge away from the planar surface. The second side comprises first and second layers, wherein the first layer is positioned between the planar surface and the second layer and comprises an adaptable cushion for conforming to the surface area of the object resting on the protection stand. The second layer comprises an assembly side and an attachment side, both of such sides comprising an adhesive bond for securing the assembly side to the first layer and the attachment side to the cross-sectional surface of the object resting on the protection stand.

Another example embodiment of the present disclosure comprises a protection stand for use with a furniture object. The protection stand includes a planar surface having first and second sides. The first side of the planar surface comprises a plurality of conical stands that converge away from the planar surface. The second side comprises first and second layers, wherein the first layer is positioned between the planar surface and the second layer and includes an adaptable cushion for conforming to the surface area of the object resting on the protection stand. The second layer includes an assembly side and an attachment side, both of such sides comprises an adhesive bond for securing the assembly side to the first layer and the attachment side to the surface of the object resting on the protection stand during use. The protection stand also includes a least one perforation or line of weakness that allow for adjustable sizing of the protection stand to substantially match the surface of the object resting thereon during use.

While another example embodiment of the present disclosure comprises a method of constructing a protection stand for protecting carpet from an object to be positioned on the protection stand during use. The method comprises the steps of forming a planar surface from plastic having first and second sides, the first side of the planar surface comprising a plurality of conical stands that converge away from the planar surface positioning first and second layers on the second side of the planar surface. The first layer is positioned between the planar surface and the second layer and includes an adaptable cushion for conforming to the surface area of the object resting on the protection stand during use. The method also includes the step of providing an adhesive bond to both an assembly side and attachment side of the second layer, the adhesive bond for securing the assembly side of the second layer to the first layer and the attachment side to the surface of the object resting on the protection stand during use.

BRIEF DESCRIPTION OF THE DRAWINGS

The foregoing and other features and advantages of the present disclosure will become apparent to one skilled in the art to which the present invention relates upon consideration of the following description of the invention with reference to the accompanying drawings, wherein like reference numerals refer to like parts unless described otherwise throughout the drawings and in which:

FIG. 1A is perspective view of a protection stand constructed in accordance with one example embodiment of the present disclosure;

FIG. 1B is a front elevation view of FIG. 1;

FIG. 1C is a side elevation view of FIG. 1;

DETAILED DESCRIPTION

Figure 2:
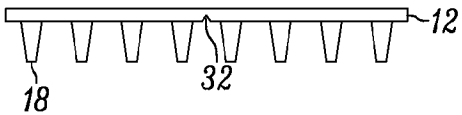
FIG. 2 is a side elevation view of a planar surface constructed in accordance with one example embodiment of the present disclosure.
Figure 3:
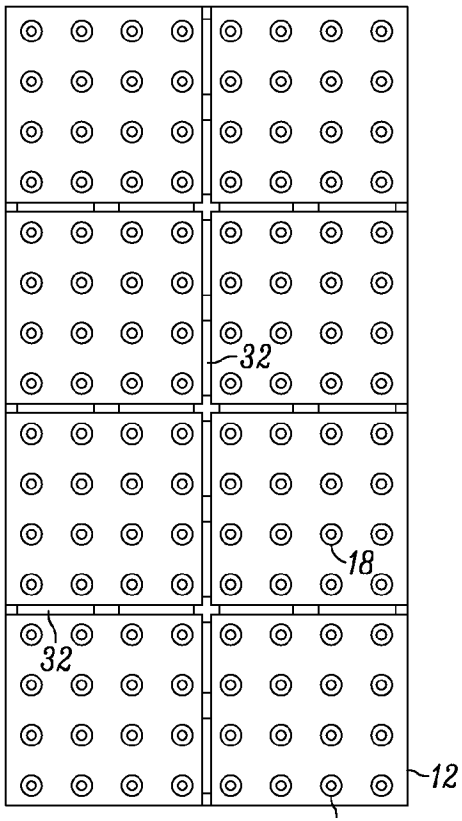
FIG. 3 is a bottom plan view of FIG. 2.
Figure 4:
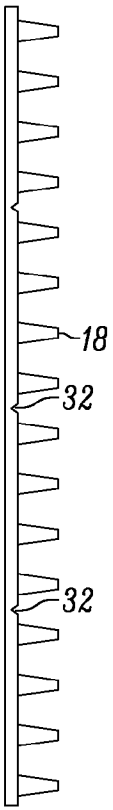
FIG. 4 is a front elevation view of FIG. 2.
Figure 5:
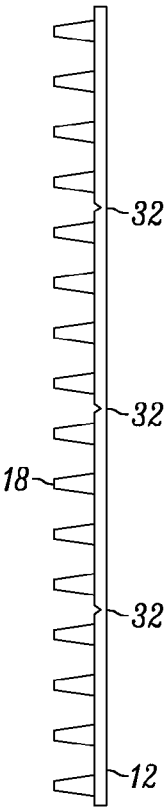
FIG. 5 is a back elevation view of FIG. 2.
Figure 6:
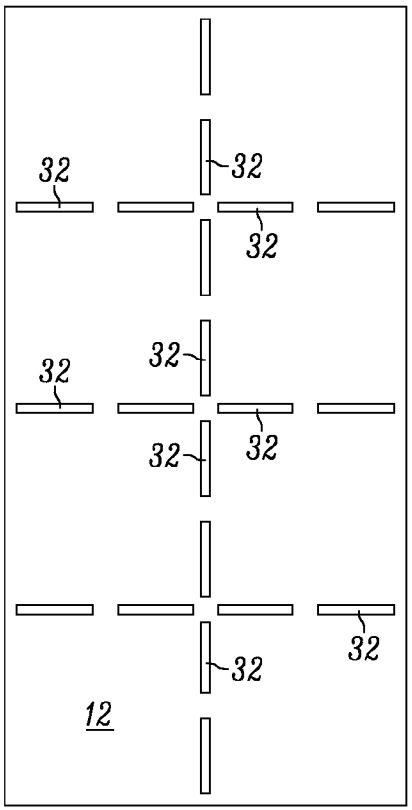
FIG. 6 is a top plan view of FIG. 2.

Referring now to the figures generally wherein like numbered features shown therein refer to like elements throughout unless otherwise noted. The present disclosure relates to a protection stand, and more particularly, a protection stand that is secured to an object to protect the surface upon which the object rests.

FIGS. 1A, 1B, and 1C illustrate a protection stand 10 constructed in accordance with one example embodiment of the present disclosure. The protection stand 10 comprises a substantially planar surface 12 having first 14 and second 16 sides. The first side 14 further comprises a plurality of conical stands 18 that converge away from the planar surface 12.

The protection stand 10 further comprises first and second layers 20, 22, respectively attached to the second side 16. The first layer 20 is positioned between the planar surface 12 and the second layer 22. The first layer 20 is formed from an adaptable cushion 24 that conforms to the surface area of the object resting on the protection stand 10 and is adhered to the second side 16 with an adhesive bond 15 such as glue. The second layer 22 includes an assembly side 26 and an attachment side 28, both of the sides comprise an adhesive bond 30. The adhesive bond 30 allows the assembly side 26 to secure itself to second side 16 and first layer 20 of the planar surface 12 and the attachment side 28 to secure itself and the protection stand 10 to the object resting thereon.

In one example embodiment, the second layer 22 is formed from double-sided tape that includes a protective cover (not shown). The protective cover is removed just prior to assembly to the first layer 20 or attachment to the object and is used to protect the adhesive bond 30 during non-use or prior to assembly.

The plurality of conical stands 18 prevent the material covering the floor such as carpet, carpet pad, carpet pile, carpet backing or any combination thereof from being crushed by the object or furniture resting on the protection stand 10. The term "carpet" is further intended to include, but is not limited to, area rugs, throw rugs, wall-to-wall carpeting, etc., generally made of materials such as wool, cotton, nylon, and acrylic. The furniture positioned on the protection stand 10 is intended to include, but not limited to, tables, chairs beds, appliances, file cabinets, televisions, bookshelves, ottomans, and couches.

In the illustrated example embodiment, the substantially planar surface 12 is formed from plastic that is capable of supporting with a two (2") inch by two (2") inch protection stand, an object load equal to two hundred (200 lbs.) pounds. Accordingly, a protection stand having a geometry of four (4") inches by (4") inches is capable of supporting eight hundred (800 lbs.) pounds.

In the illustrated example embodiment, the cushion 24 is formed from a pliable material such as foam or EVA material and conforms to the profile of the object or object's leg resting thereon and acts to resist lateral or longitudinal movement in the object. The substantially planar surface 18 further comprises a plurality of weakness or perforation lines 32 that allow for the adjustable sizing of the protection stand 10 to advantageously adapt to substantially the same size as the object or leg of the object being supported. Stated another way, undesirable or non-utilized areas along the weakness lines 32 allow the planar surface 12, first layer 20, and second layer 22 to be broken from the protection stand 10 such that the size of the protection stand substantially matches cross-sectional area of the object or leg of the object being supported. This sizing of the protection stand 10 can occur prior to or after the attachment of the stand to the object.

The weakness lines 32 once snapped by the user allows for the convenient tearing of the first and second layers, 20, 22 along separation lines, matching the perforations 32 without the need or use of tools. In the illustrated example embodiment, the protection stand 10 is four (4") inches by eight (8") inches in rectangle form having weakness lines 32 in two (2") inch by (2") inch squares. However, the size and geometrical configuration of the protection stand 10 and weakness lines 32 can be any shape and pattern without departing from the spirit and scope of the present disclosure.

In the illustrated example embodiment, the plurality of conical stands 18 each have a uniform length extending from the planar surface 12 to accommodate the corresponding carpet or carpet pile. In one example embodiment, the length of each conical stand is approximately ⅜" of one inch for short carpet and ⅝" of one inch for long or shag type carpet.

Figure 7:
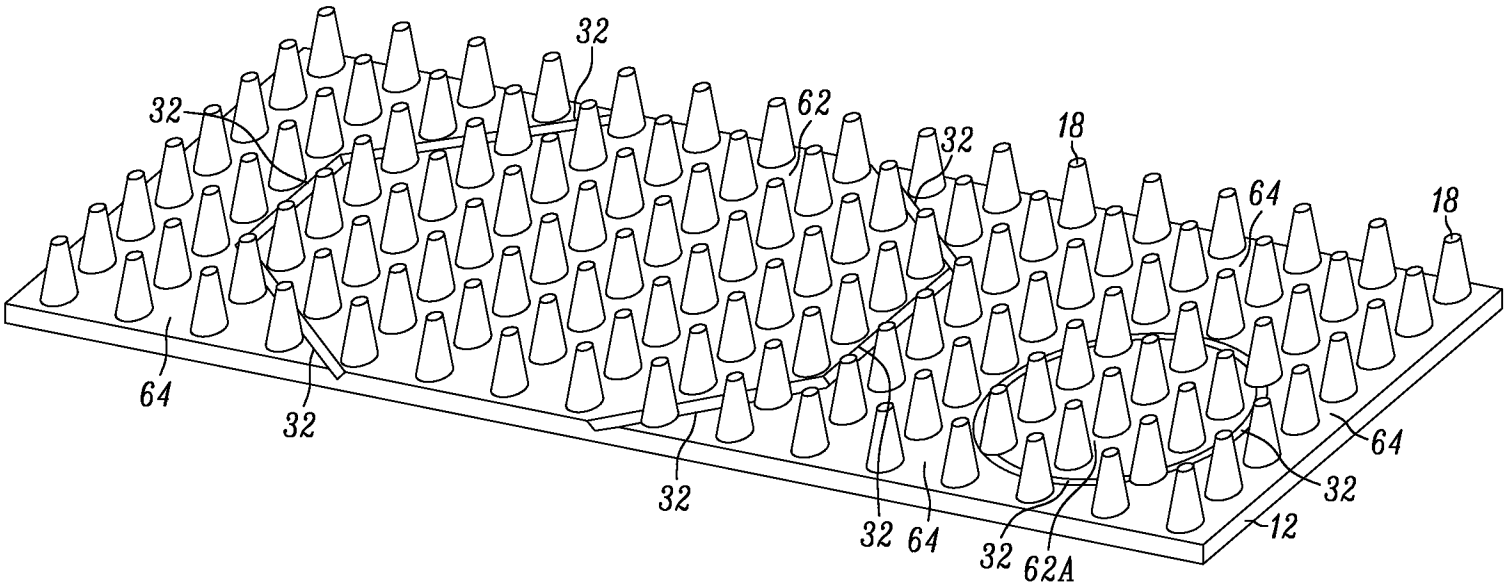
FIG. 7 is a perspective view of a planar surface constructed in accordance with another example embodiment of the present disclosure.

Referring now to FIG. 7 is a planar surface 12 constructed in accordance with another embodiment of the present disclosure having lines of weakness 32 in a non-square-like or non-rectangular-like form. In the illustrated example embodiment, the planar surface 12 lines of weakness 32 is an eight-sided octagon that achieves a better fit with an object or object's leg that is circular in form.

In the illustrated example embodiment of FIG. 7, a designated surface 62 includes the planar surface 12 and correspondingly shaped first and second layers 20, 22 that are to be covered or in contact with the object during use. The designated surface 62 can be any shape, including circular and non-circular, defined by perforations 32 about the perimeter of the designated surface. In the illustrated example, the designated surface 62 is an octagon.

The region of the protection stand 10 not in use or outside of the designated surface 62 are designated portions 64 (see FIG. 7). The designated portions 64 are not in contact or covered by the object during use and therefore, the planar surface 12, and corresponding first and second layers 20, 22, respectively are separated along the perforations 32 from the designated surface 62 and discarded or saved for use with another object. By reducing the size of the protection stand 10 to the designated surface 62, it allows the protection stand to be more tightly conforming to the designated object size advantageously for aesthetic purposes.

FIG. 7 further illustrates a circular designated surface 62A within designated portion 64 that can be used for a circular object, such as furniture. Similarly, the designated surface 62A is separated from the designated portions 64 by circular perforation 32. The first and second layers 20, 22, respectively tear along the circular perforation lines 32 for use with a correspondingly sized circular object.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications, and variations that fall within the spirit and scope of the appended claims.

What is claimed is:

1. A protection stand comprising:

a planar surface having first and second sides, the first side of the planar surface comprising a plurality of spaced apart conical stands that converge away from the planar surface;

the second side comprises first and second layers, wherein the first layer is positioned between the planar surface and the second layer and includes an adaptable cushion for conforming to a surface area of an object resting on the protection stand;

the second layer comprises an assembly side and an attachment side, both of such sides comprising an adhesive bond, the adhesive bond extending across an extent of the second layer for securing the assembly side of the second layer to the first layer and the attachment side of the second layer to a surface of an object resting on the protection stand.

2. The protection stand of claim 1 wherein said planar surface further comprises a plurality of perforations or lines of weakness that allow for adjustable sizing of the protection stand to substantially match a surface of an object resting thereon during use.

3. The protection stand of claim 2 wherein said protection stand has four sides forming said planar surface, wherein each side has a parallel opposing side and two transverse sides such that said plurality of perforations extend between said parallel opposing sides and transverse sides.

4. The protection stand of claim 1 wherein said protection stand has a plurality of sides forming said planar surface and at least one line perforation extending across said sides or located within said sides to form a circular protection stand.

5. The protection stand of claim 2 wherein said perforations form a circular protection stand when discarded portions of said protection stand are removed along said perforations.

6. The protection stand of claim 5 wherein said discarded portions comprise portions of the planar surface, first layer, and second layer that are not in contact with a surface of an object designated to rest on the protection stand during use.

7. The protection stand of claim 2 further comprising designated portions to be discarded comprising portions of the planar surface, first layer, and second layer that are not in contact with a designated surface comprising the planar surface, first layer, and second layer intended to have a substantial portion covered or in contact with an object designated to rest on the protection stand during use, the designated portions separated from the protection stand by said plurality of perforations.

8. The protection stand of claim 7 wherein said designated surface is one of circular and non-circular.

9. A protection stand for use with a furniture object, the protection stand comprising:

a planar surface having first and second sides, the first side of the planar surface comprising a plurality of spaced apart conical stands that converge away from the planar surface;

the second side comprises first and second layers, wherein the first layer is positioned between the planar surface and the second layer and includes an adaptable cushion for conforming to a surface of an object resting on the protection stand;

the second layer comprises an assembly side and an attachment side, both of such sides comprising an adhesive bond, the adhesive bond extending across an extent of the second layer for securing the assembly side of the second layer to the first layer and the attachment side of the second layer to a surface of an object resting on the protection stand during use; and a least one perforation or line of weakness that allow for adjustable sizing of the protection stand to substantially match an area of an object resting thereon during use.

10. The protection stand of claim 9 wherein said first layer comprises one of foam and EVA material.

11. The protection stand of claim 9 wherein said second layer comprises double sided tape.

12. The protection stand of claim 9 wherein said planar surface is formed from molded plastic.

13. The protection stand of claim 9 further comprising designated portions to be discarded comprising portions of the planar surface, first layer, and second layer that are not in contact with a designated surface comprising the planar surface, first layer, and second layer intended to have a substantial portion covered or in contact with an object designated to rest on the protection stand during use, the designated portions separated from the protection stand by said plurality of perforations.

14. A method of constructing a protection stand for protecting carpet from an object to be positioned on the protection stand during use, the method comprising the steps of:

forming a planar surface from plastic having first and second sides, the first side of the planar surface comprising a plurality of spaced apart conical stands that converge away from the planar surface;

positioning first and second layers on the second side of said planar surface, the first layer is positioned between the planar surface and the second layer and includes an adaptable cushion for conforming to a surface of an object resting on the protection stand during use;

providing an adhesive bond to both an assembly side and attachment side of said second layer, the adhesive bond extending across an extent of the second layer for securing the assembly side of the second layer to the first layer and the attachment side of the second layer to a surface of an object resting on the protection stand during use.

15. The method of claim 14 further comprising the step of providing a plurality of perforations or lines of weakness that allow for adjustable sizing of the protection stand to substantially match an area of an object resting thereon during use.

16. The method of claim 15 further comprising the step of providing said plurality of perforations in both circular and non-circular patterns on said planar surface.

17. The method of claim 14 further comprising the step of identifying designated portions to be discarded comprising portions of the planar surface, first layer, and second layer that are not in contact with a designated surface comprising the planar surface, first layer, and second layer intended to have a substantial portion covered or in contact with an object designated to rest on the protection stand during use, and separating the designated portions from the protection stand by said plurality of perforations.

* * * * *